US005772147A

United States Patent [19]

Stein

[11] Patent Number: 5,772,147

[45] Date of Patent: Jun. 30, 1998

[54] APPARATUS FOR PERFORMING A WORK OPERATION ON SHEET MATERIAL AND A SHEET MATERIAL FEED MECHANISM THEREFOR

[75] Inventor: Darryl Colburn Stein, Andover, Conn.

[73] Assignee: Gerber Garment Technology, Inc., Tolland, Conn.

[21] Appl. No.: 505,490

[22] Filed: Jul. 21, 1995

[51] Int. Cl.[6] ..... B65H 23/18; B65H 20/00

[52] U.S. Cl. ..... 242/418.1; 242/538.2; 242/615; 226/190

[58] Field of Search ..... 242/411, 412.1, 242/412.2, 413.3, 413.4, 413.5, 418.1, 420.6, 538.1, 538.2, 548, 566, 615, 615.2, 615.4; 226/44, 181, 183, 185, 186, 187, 190, 193, 194

[56] References Cited

U.S. PATENT DOCUMENTS

| | | | |
|---|---|---|---|
| 2,000,918 | 5/1935 | Broms . | |
| 2,622,448 | 12/1952 | Lorig | 226/190 |
| 3,318,544 | 5/1967 | Jones, Jr. | 242/412.2 |
| 3,360,174 | 12/1967 | Evert | 226/190 |
| 3,416,051 | 12/1968 | Pinto et al. | 242/418.1 |
| 3,786,975 | 1/1974 | Heymanns | 226/194 |
| 3,810,571 | 5/1974 | Fatula . | |
| 3,859,940 | 1/1975 | Nakamura . | |
| 3,878,999 | 4/1975 | Daves . | |
| 3,927,844 | 12/1975 | Bond et al. | 242/418.1 |
| 3,942,735 | 3/1976 | Marchio et al. | 242/538.2 |
| 4,027,828 | 6/1977 | Mathieson . | |
| 4,033,497 | 7/1977 | Przygocki . | |
| 4,265,413 | 5/1981 | Burns et al. . | |
| 4,456,193 | 6/1984 | Westover | 242/538.2 |
| 4,534,498 | 8/1985 | Nilsson | 226/183 |
| 4,683,480 | 7/1987 | Sakamoto et al. | 226/181 |
| 4,752,145 | 6/1988 | Schelshorn et al. | 226/194 |
| 5,009,177 | 4/1991 | Sato et al. . | |
| 5,101,219 | 3/1992 | Gerber et al. . | |
| 5,146,862 | 9/1992 | Sato et al. . | |
| 5,201,595 | 4/1993 | Oda . | |
| 5,423,495 | 6/1995 | DeNagel et al. | 226/119 |
| 5,597,105 | 1/1997 | Keller | 242/418.1 |

FOREIGN PATENT DOCUMENTS

| | | | |
|---|---|---|---|
| 0 252 844 A1 | 1/1988 | European Pat. Off. . | |
| 1 774 689 | 12/1971 | Germany . | |
| 58-104863 | 6/1983 | Japan | 226/190 |
| A-59-152865 | 8/1984 | Japan . | |
| 59-190151 | 10/1984 | Japan . | |
| 63-71060 | 3/1988 | Japan | 242/418.1 |
| 13113241 | 12/1989 | Japan . | |
| 2-263509 | 10/1990 | Japan | 226/181 |
| A-4-182024 | 6/1992 | Japan . | |
| 5-294529 | 11/1993 | Japan | 226/190 |
| 172 209 | 7/1960 | Sweden | 226/194 |
| 674253 | 6/1952 | United Kingdom . | |
| 832106 | 4/1960 | United Kingdom | 242/615 |
| 2 023 553 | 1/1980 | United Kingdom . | |
| 2 144 106 | 2/1985 | United Kingdom . | |
| WO 93/08110 | 4/1993 | WIPO . | |

OTHER PUBLICATIONS

IBM Technical Disclosure Bulletin vol. 12 No. 3 p. 406, Freeman et al., Aug. 1969.

*Primary Examiner*—John P. Darling
*Attorney, Agent, or Firm*—McCormick, Paulding & Huber

[57] ABSTRACT

A dancer bar including a plurality of segments flexibly linked together is provided. Preferably, the segments are selectively connectable to provide a dancer bar having a length which substantially equals the width of an associated web of sheet material. A sheet material feed mechanism including the segmented dancer bar and an apparatus for performing a work operation on sheet material including the feed mechanism are also provided.

21 Claims, 6 Drawing Sheets

APPARATUS FOR PERFORMING A WORK OPERATION ON SHEET MATERIAL AND A SHEET MATERIAL FEED MECHANISM THEREFOR

BACKGROUND OF THE INVENTION

The present invention relates to apparatus for performing work operations on sheet materials. More particularly, the present invention relates to a sheet material feed mechanism including a segmented dancer bar for such apparatus.

For convenience, the segmented dancer bar and feed mechanism of the present invention will be described in connection with an X-Y plotter of the type used, for example, in the garment industry for drawing markers showing pattern pieces to be cut from a length of fabric. It should be understood, however, that the invention is in no way limited to such an application and that the dancer bar and feed mechanism taught by the invention can used with other devices for performing work operations on an elongated web of sheet material. For example, the sheet material feed mechanism disclosed herein can form part of a fabric or vinyl cutting device, or a device for printing alpha-numeric figures or graphics on such sheet materials.

Plotters are typically used as part of a computer assisted pattern grading and marker making system as shown, for example, in U.S. Pat. No. 3,887,903. In such a plotter, the sheet material on which the drawing or marker is made is usually paper and the writing instrument is usually a pen. Therefore, in the following description and in the accompanying drawings, the sheet material is referred to and shown as paper and the work tool is referred to and shown as a pen. As noted above, other sheet materials and tools may be used depending on the work operation to be performed, and even in the case of a plotter the sheet material and writing instrument is not limited to paper and pen. For example, the invention encompasses a photo plotter with the material on which the drawing is made being a sheet of photosensitive film and the writing instrument being a beam of light moved over the film in a line drawing manner to expose lines on the film.

Plotters generally referred to by those skilled in the art as "progressive plotters" include a pen movable in X and Y coordinate directions over and relative to the plotting area of a paper support surface, with the plotting area having only a short dimension parallel to the length of the paper as compared to the length of the drawing to be plotted. As the paper is moved lengthwise in one direction over the plotting area, a drawing is created progressively along its length. The operation of the plotter may be characterized by either intermittent paper movement alternating with intermittent plotting, by continuous paper movement combined with continuous plotting, or by a combination of the previous two modes of operation.

Typically, the plotter is operated according to the first alternative, wherein a drawing to be created is divided into a number of sections arranged next to one another lengthwise of the drawing and is draw one section at a time. That is, one section of paper is presented to the plotting area of the plotter at a time and held stationary relative thereto. The pen is then moved in X and Y coordinate directions relative to the plotting area to draw a section of the intended drawing on the section of paper then at the plotting area. After this section of the drawing is completed, the paper is advanced lengthwise to bring a next such section of paper to the plotting area in order to complete the next section of the drawing. The process is repeated section by section until the entire drawing is finished.

An important requirement of progressive plotters is that the paper track accurately over the plotting area so that in the case of lines necessarily made up of parts drawn at different times with the paper differently positioned relative to the plotting area, the trailing end of one line segment will coincide exactly with the leading end of the next segment to shown no discontinuities in a finished complete line. If the paper drifts laterally with respect to its direction of movement across the support surface, or if the paper buckles or otherwise distorts during advancement, unacceptable misregistrations of line parts, or other drawing errors, are likely to occur.

It is therefore an object of the invention to provide a feed mechanism for use with plotters and other devices for performing a work operation on sheet materials, which feed mechanism insures that the sheet material will advance or track accurately across the work surface of the device.

It is a further object of the invention to provide such a feed mechanism which is capable of directing or advancing sheet materials of varying width across the work surface of the device.

It is a still further object of the invention to provide a relatively low cost plotter which utilizes such a feed mechanism and which is operable to produce long drawings at sufficient speed with a finished, presentable computer drawing having smooth, uninterrupted lines.

SUMMARY OF THE INVENTION

The present invention meets these and other objects by providing, in one aspect, a segmented dancer bar for use in a sheet material feed mechanism. The dancer bar taught by the invention is distinguished from one-piece dancer bars commonly employed in such feed mechanisms in that it includes a plurality of segments flexible linked together. Since the segments of the bar are flexibly linked together, the bowing which typically occurs due to the weight of a one-piece bar is eliminated. The segmented bar is preferably constructed so that it has a length substantially equal to the width of the sheet material. Accordingly, since the length of the bar substantially equals the width of the sheet material, and the flexibly linked segments eliminate bowing, the dancer bar, when received within the bight of a loop of sheet material, applies substantially equal pressure across the entire width of the material. In the preferred embodiment of this aspect of the invention the dancer bar includes a plurality of connectable segments flexibly linked together. Thus, the length of the bar can be adjusted to sheet materials of varying width simply by selectively combining the segments. In this connection, the segments comprising the bar can be made of varying length so that by combining the appropriate segments the length of the dancer bar can be adjusted to more precisely equal the width of a particular sheet material on which a work operation is to be performed.

In a second aspect, the invention provides a feed mechanism for use with a device for performing a work operation on sheet material. The feed mechanism includes means for supporting a supply roll of the sheet material to be worked on by the device, and a feed roller for receiving sheet material from the supply roll and advancing the sheet material across a work surface of the device. The supply roll and feed roller are arranged relative to one another to define a loop of sheet material extending therebetween, and a dancer bar is received within the bight of the sheet material loop to pull downwardly on the sheet material and apply tension thereto. The tension applied to the sheet material by the dancer bar causes the material to be drawn firmly against the work surface so that the sheet material tracks accurately over the work surface and does not buckle or otherwise distort as it is advanced by the feed roller. Preferably, the dancer bar includes a plurality of segments flexibly linked together and has a length substantially equal to the width of the material, as described above.

In a third aspect, the invention provides a device for performing a work operation on sheet material which includes a work surface for supporting the sheet material during the work operation, and a tool supported above the work surface for movement relative thereto. The work surface has an input end and a take-off end, and the device further includes means for supporting a supply roll of the sheet material at the input end of the work surface. A feed roller for receiving sheet material from the supply roll and advancing the sheet material across the work surface of the device is also provided, and the supply roll and feed roller are arranged relative to one another to define a loop of sheet material extending therebetween. A segmented dancer bar of the type described above is received within the bight of the sheet material loop to pull the sheet material downwardly and apply tension to the material. Preferably, the feed roller is positioned at the take-off end of the work surface and the bight of the loop of sheet material is located between the supply roll and the input end of the work surface.

DETAILED DESCRIPTION OF THE INVENTION

As noted above, the invention has utility with a wide variety of devices for performing work operations on sheet material. In the present case, however, all three aspects of the invention mentioned above will be disclosed in connection with the description of the progressive plotter illustrated in the accompanying figures.

Figure 1:
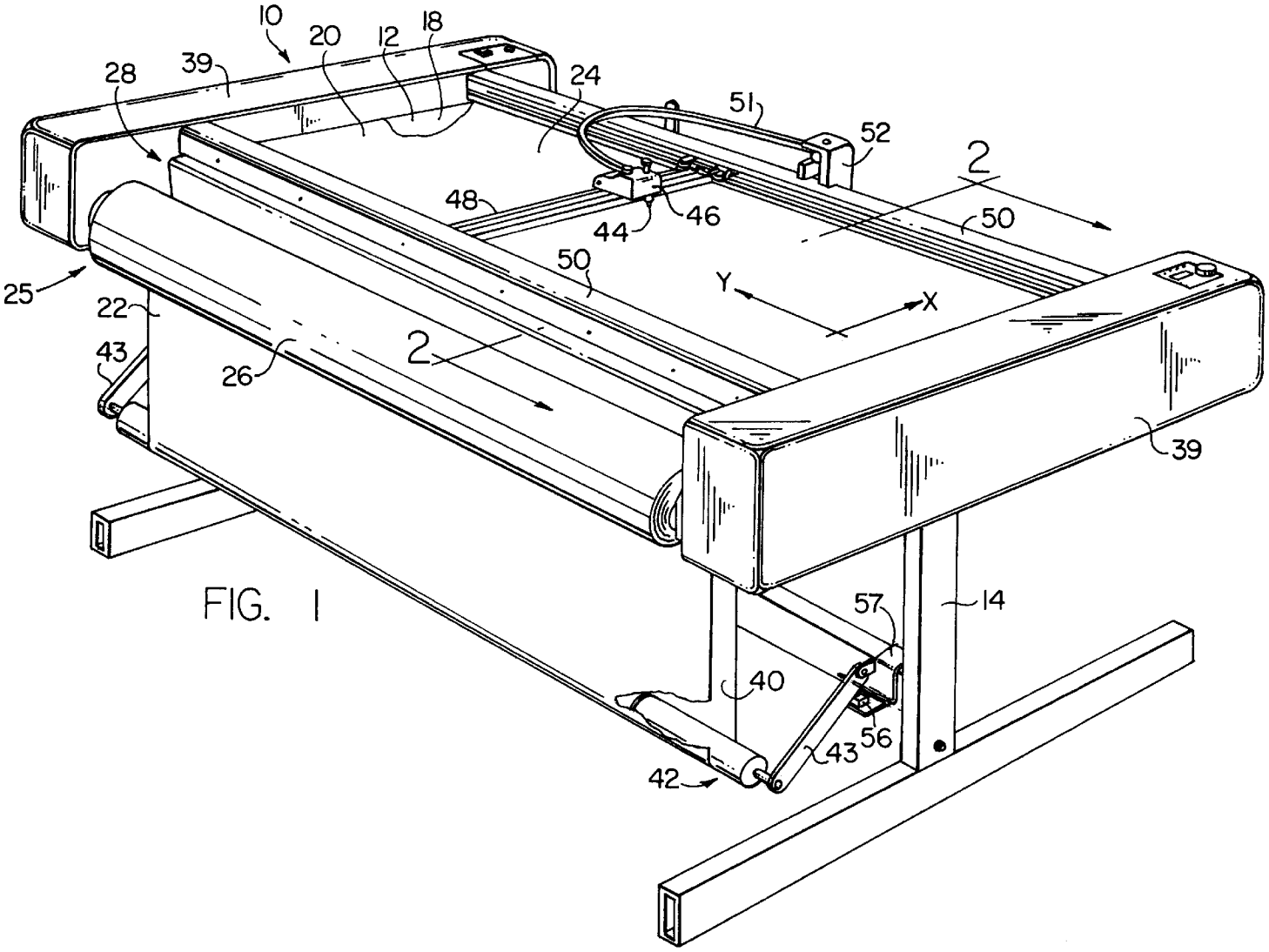
FIG. 1 is a front perspective view of a plotter embodying the invention.
Figure 2:
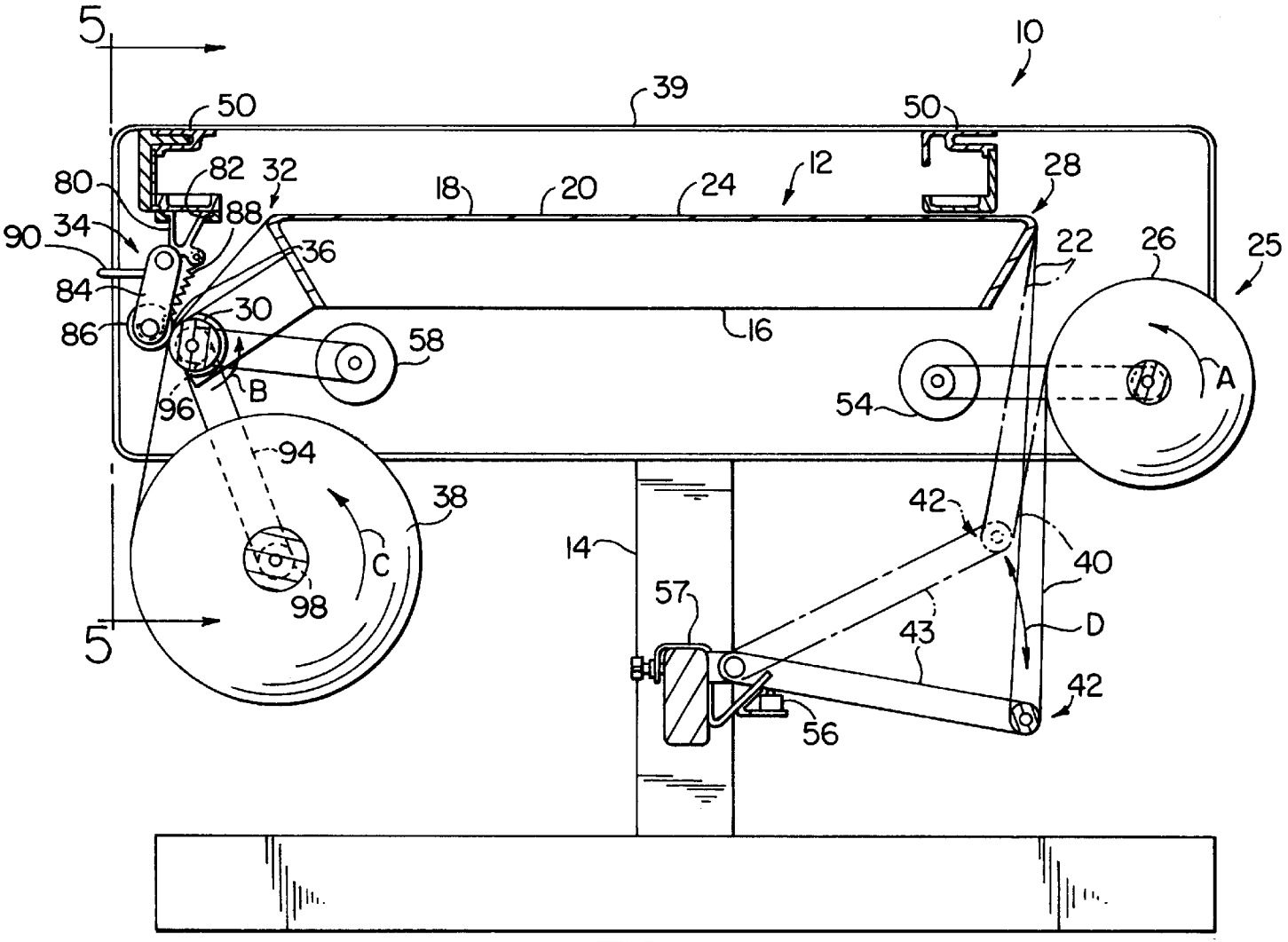
FIG. 2 is side cross-section view of the plotter shown in FIG. 1 taken along the line 2—2.

As shown in FIGS. 1 and 2, the plotter, generally designated 10, includes a table 12, a base 14 and frame 16. The table provides an upwardly facing horizontal work surface 18 for supporting a portion 20 of a web of paper 22. The paper provides an upwardly facing receiving surface 24 onto which lines are drawn by a pen to create graphics such as, for example, a marker used in the garment industry to show the shape and arrangement of pattern pieces to be cut from a lay-up of cloth sheets. The paper web 22 is supplied by a feed mechanism, generally indicated at 25, including a supply roll 26 supported at an input end 28 of the work surface 18 for rotation relative to the frame in the direction indicated by arrow A shown in FIG. 2. The paper is advanced across the support surface by a feed roller 30 supported at a take-off end 32 of the work surface for rotation relative to the frame in the direction indicated by arrow B, also shown in FIG. 2. The feed roller 30 and a plurality of gripping members 34, 34 (shown best in FIG. 5) cooperated to define a nip 36 within which the paper is received and held while it is advanced across the work surface, as will be explained more fully below. The paper is then wound onto a take-up roll 38 which is also mounted on the frame for rotation relative thereto in the direction indicated by arrow C.

As can be seen in FIGS. 1 and 2, the supply roll 26 and the feed roller 30 are arranged relative to the table 12 so as to define a loop of paper extending therebetween. In the embodiment of the invention shown in these figures, the bight 40 of the loop is located between the supply roll and input end 28 of the work surface. A segmented dancer bar, shown generally at 42, is received within the bight 40 and is attached at both ends to a pair of pivot arms 43, 43 which extend from the base 14 of the table 12. The dancer bar tends to pull the paper web 22 downwardly and apply tension to the web, and the tension applied to the web by the dancer bar causes the portion 20 of the web 22 to be drawn firmly against the work surface 18 so that the web tracks accurately over the work surface and does not buckle or otherwise distort as it is advanced by the feed roller. The structure and function of the dancer bar 42 will be described in more detail below in connection with the description of FIG. 3.

Referring now to the operation of the plotter, graphics are drawn on the receiving surface 24 of the web portion 20 supported by the work surface 18 by means of a pen 44. The pen forms a part of a pen head 46 moveable in the illustrated X and Y coordinate directions, the pen head being moveable in the X coordinate direction relative to a carriage 48 extending in the X direction and moveable in the Y direction along the length of two side rails 50, 50 extending in the Y direction at opposite ends of the table 12. Electrical power, electrical signals and pressurizing air for pressurizing the ink used by the pen 44 are communicated between the pen head 46 and the remainder of the plotter by a flexible wand 51 connected to the pen head at one end and at its other end pivotally connected to a fitting 52 fixed to one of the rails 50 as shown. The movement of the pen with respect to the work surface and the operation of the pen to draw a graphic on each portion of the web supported on the work surface, are accomplished automatically under the direction of command signals provided by a controller (not shown) which is connected to other parts of a computer assisted marker making and grading system or the like in a manner well-known in the art.

Figure 4:
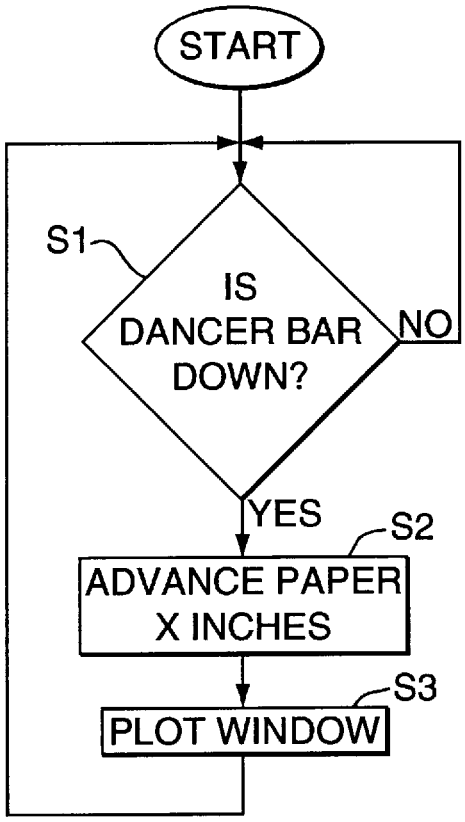
FIG. 4 is a flow diagram illustrating the operation of the feed mechanism of the plotter shown in FIG. 1.

Referring to FIGS. 1, 2 and 4 the section-by-section advancement of the paper web 22 onto the work surface 18 by the feed mechanism will now be described. In this connection it should be noted that FIG. 4 is a flow chart which illustrates conceptually the procedural steps for advancing the web in accordance with the present invention.

At the start of each cycle for advancing a fresh portion 20 of the paper web onto the work surface, i.e., after the previous portion has been advanced and plotted, the dancer bar is at the elevated position shown in phantom in FIG. 2. According to step S1 of the control procedure, the controller determines whether or not the dancer bar is in the lowered position shown in full-line in FIG. 2. As long as the dancer bar is not in this lowered position, the controller provides a command signal to a drive motor 54, shown schematically in FIG. 2, which rotates the supply roll 26 in the direction indicated by arrow A to supply a quantity of the paper web 22. As the supply roll unwinds and the loop extending between the supply roll and the feed roller lengthens, the dancer bar is lowered from the elevated position to the lowered position along the arc indicated by arrow D in FIG. 2. The supply roll continues to unwind until one of the pivot arms (the pivot arm on the right side of the plotter as shown in the illustrated embodiment) contacts a micro-switch 56 mounted on the corresponding side of the base 14, which disengages the drive motor 54. The micro-switch is mounted on the base 14 at a height with respect to the height of the supply roll such that the vertical distance between the elevated and lowered positions of the dancer bar shown in FIG. 2 equals the desired length of the portion 20 of the web to be advanced onto the work surface for plotting. Preferably, this distance also equals the extent of the work surface in the X-coordinate direction so that the portion 20 covers the entire work surface in this direction.

Once the drive motor 54 disengages, the controller continues to step S2 of the procedure and provides a command signal to a drive motor 58, shown schematically in FIG. 2, which rotates the feed roller 30 in the direction indicated by arrow B to advance the paper web across the work surface in the X-coordinate direction a distance which equals the length of paper supply from the roll 26 in step S1 of the procedure. Thus, the feed mechanism operates to advance a fresh portion 20 of the web onto the work surface for plotting. It should be understood that as the web is advanced by the feed roller the dancer bar returns to the elevated position, traveling along the arc indicated by arrow D. The micro-switch 56 and the associated pivot arm 43 are slidably mounted on the base 14 by an adjustable clamp 57 which permits positioning of the pivot arm and switch anywhere along the width of the plotter. Thus, as the length of the dancer bar is adjusted to the corresponding width of the particular web being fed onto the work surface, the distance between the pivot arms can be adjusted accordingly.

Once the feed roller advances the web the required distance, the control procedure moves to step S3, wherein the controller provides command signals to the pen head 46 and the carriage 48 to cause a graphic to be printed onto the portion 20 of the web advanced by the feed mechanism. After the plotting of this portion of the web is complete, the control procedure is repeated to advance a fresh portion of the web to the work surface. The procedure is continuously repeated until plotting of the entire mark or other desired drawing is complete.

Figure 3:
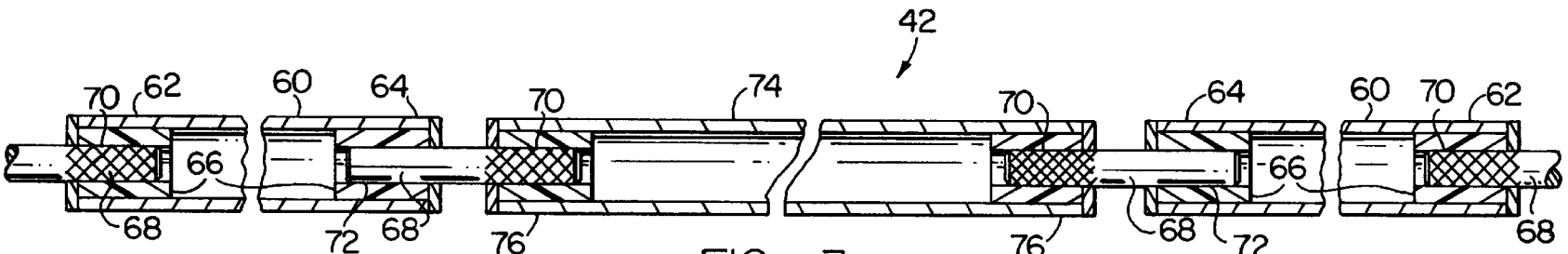
FIG. 3 is a partial cross-section of the segmented dancer bar which forms a part of the feed mechanism of the plotter shown in FIG. 1.

Turning now to a more detailed description of the dancer bar, and in particular to FIG. 3, the dancer bar 42 includes a plurality of hollow metal segments 60, 60 having both a male end 62 and a female end 64. Both ends of each segment 60, 60 have sockets 66, 66 pressed therein. In the disclosed embodiment the sockets are made from a durable but slightly deformable plastic, such as, for example, DELRIN™ supplied by Du Pont de Nemours, E. I. and Company. The male end 62 is formed by pressing a pin 68 into the corresponding socket. The pin has a ribbed, knurled or otherwise roughened surface 70 along that portion of its length which is pressed within the socket. Moreover, the pin is dimensioned such that this surface will slightly deform the socket when the pin is pressed therein, which insures that the pin remains fixedly engaged within the socket. The remainder of the length of the pin 68 is dimensioned so that the corresponding surface 72 can be manually inserted into the socket at the female end of any other segment, and disconnected by pulling the pin from the socket in the same manner. The surface 72 is also dimensioned to provide for sufficient play between this surface and the socket so that the links between the segments are flexible. However, the fit between the surface 72 and the socket must be sufficiently tight to prevent the segments form becoming disengaged while the feed mechanism is in operation and the dancer bar is received within the light of the loop.

The dancer bar further includes a segment 74 which includes two male ends 76, 76 formed in the manner described above with respect to the male end 62. Since, as shown in FIG. 3, the segments are of varying length, the length of the dancer bar can be varied depending on the number and length of the individual segments comprising the bar. As will be readily understood, this is accomplished by beginning with the segment 74 having two male ends and extending the bar outwardly from either or both ends using segments 60 of the appropriate length until a dancer bar of the desired length is obtained. As noted above, the segments are combined in a manner which provides the bar with a length which substantially equals the width of the paper web being advanced onto the work surface 18. Thus, the length of the dancer bar can be easily adjusted to webs of varying width simply by selectively combining segments of different lengths.

Gaps are shown between the segments 60, 60 and 74 on FIG. 3. However, for the purpose of clarity these gaps have been exaggerated. In an actual dancer made according to the invention, the segments butt against one another with a slight gap that develops due to the flexible links permitted by the fit between the surface 72 and the sockets 66, 66. As noted above, this flexibility of the bar eliminates the bowing which typically occurs in prior art dancer bars made as a single piece. Thus, the dancer bar 42 applies uniform downward pressure along the entire width of the paper web 22. This is not the case with prior art one-piece bars which, due to their bowing, provide more pressure at the center of the web than at the edges. By maintaining a uniform downward pressure across the entire width of the web, skewing and buckling of the web as it is advanced across the work surface is eliminated. It should also be appreciated that in the case of a one-piece bar of fixed length, the bar either extends past the lateral edges of the web or is displaced inwardly from the edges as webs of varying width are fed to the work surface. Additional weight overlaying the edges of the web in the case of a bar longer than the width of the paper, or weight directed to the mid-portion of the web only in the case of a bar having a length shorter than the width of the web also cause errors in tracking of the web as it is fed across the work surface. By providing a dancer bar having a length which is adjustable according to the width of the web, the present invention eliminates tracking errors which result from a bar which is either too long or too short for the particular web being advanced by the feed mechanism.

Figure 5:
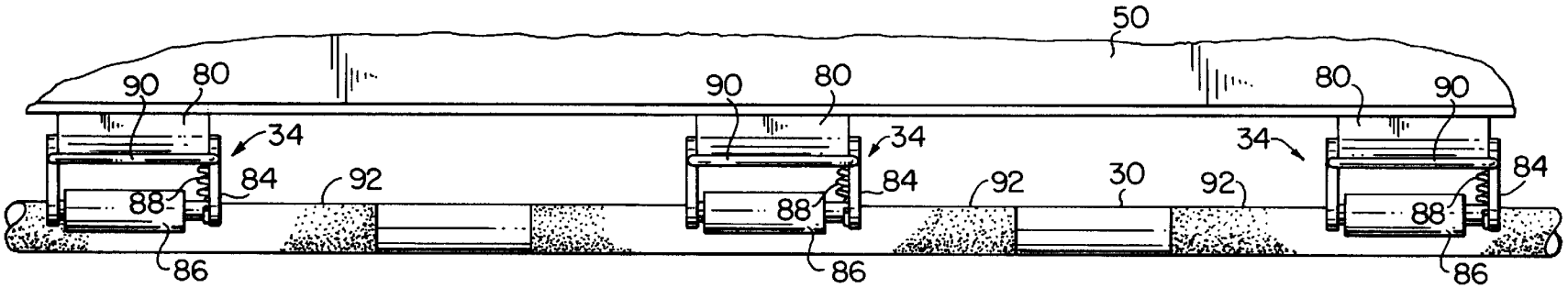
FIG. 5 is a partial cross-section of the plotter shown in FIG. 2 taken along the line 5—5.

Returning again to the description of the feed mechanism and referring to FIGS. 2 and 5, the feed roller 30 has a plurality of associated gripping members, shown generally 34, 34, which cooperate with the feed roller to define a nip 36 within which the web 22 is received and gripped as the feed roller advances a fresh portion 20 of the web onto the work surface 18 for plotting. Each of the gripping members comprises a frame 80 slidably received within a T-shaped slot 82 formed on the underside of the side rail 50 located at the take-off end 32 of the work surface 18. A bracket 84 pivotally mounts a gripping roller 86 to the frame 80, and an over-center spring 88 biases the gripping roller into engagement with the feed roller when the bracket 84 is pivoted by means of the handle 90 from a raised position (not shown) toward the feed roller 30.

Thus, the gripping rollers can be easily and selectively moved into and out of engagement with the feed roller to selectively grip or release the web 22. Moreover, since the frame of each gripping member is slidably received within the T-shaped slot, the position of each gripping member along the length of the feed roller can be selectively adjusted according to the width of the web. In the preferred embodiment of the invention, selected portions 92, 92 of the surface of the feed roller are covered with a high friction material, such as mildly abrasive paper, to enhance the gripping force applied to the web at the nip.

As also shown in FIG. 2, the feed roller 30 is drivingly connected to the take-up roller 38 by means of a belt 94, a pulley 96 mounted on the feed roller and a pair of hubs 98, 98 mounted on the take-up roll (only one shown). Thus, as the feed roller is rotated in the direction of arrow B, the web leaving the nip 36 is wound onto the take-up roll as it is rotated in the direction of arrow C. A more detailed description of the hubs and the manner in which the take-up roll 38 is driven by the feed roller 30 is set forth in commonly assigned, copending U.S. patent application Ser. No. 08/505,100 filed on even date herewith, now U.S. Pat. No. 5,632,455, the disclosure of which is herein incorporated by reference.

Figure 6:
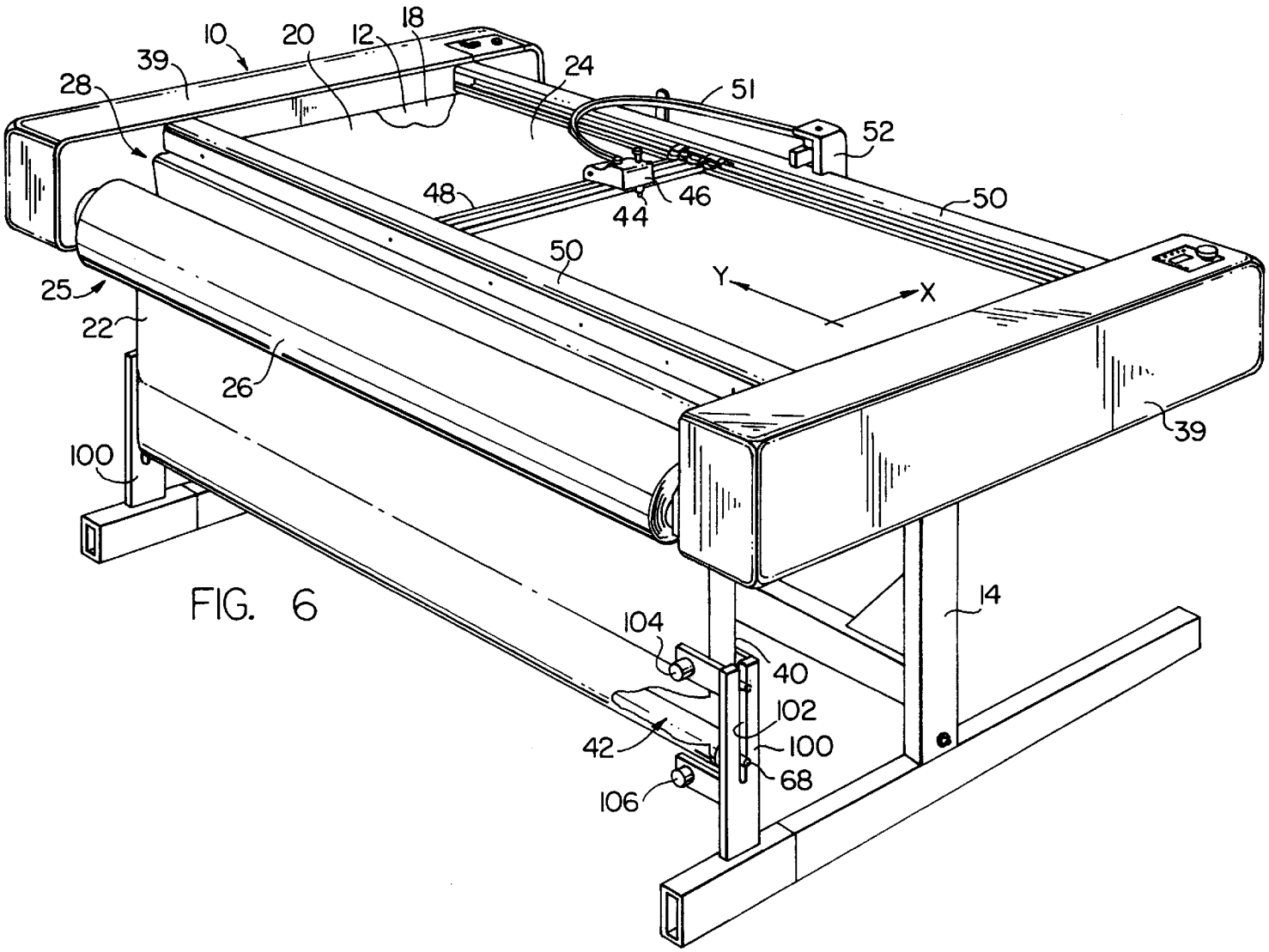
FIG. 6 is a front perspective of a second embodiment of a plotter embodying the invention.

An alternative embodiment of the invention is shown in FIG. 6. Elements of the plotter 10 which correspond to the same elements shown in FIGS. 1–5 have been given like numbers. According to the embodiment of the invention illustrated in FIG. 6, the dancer bar 42 is support on a pair of moveable vertical supports 100, 100, with the pins 68, 68 protruding from the ends of the bar slidably received within slots 102, 102 formed in the supports. Two sensors 104, 106 are mounted on one of the supports, the support shown to the right in FIG. 6, to sense the vertical height of the dancer bar when it is located at an elevated position shown in phantom in FIG. 6 and at a lowered position shown in full line in this figure.

When the dancer bar is at the elevated position, the controller is ready to begin the procedure for advancing a fresh portion 20 of the paper web onto the work surface for plotting. The procedure is initiated by a signal sent from the sensor 104 to the controller indicating that the bar is at this position. The controller then provides a command signal to the drive motor 54 which rotates the supply roll 26 to supply a quantity of the paper web 22. As the supply roll unwinds and the loop extending between the supply roll and the feed roller lengthens, the dancer bar is lowered from the elevated position to the lowered position. The supply roll continues to unwind until the sensor 106 sends a signal to the controller indicating that the dancer bar is at the lowered position. Once this signal is received, the controller disengages the drive motor 54. The sensors 104 and 106 are mounted on the supports such that the vertical distance between them, i.e., the vertical distance between the elevated position and the lowered, equals the desired length of the portion 20 of the web to be advanced onto the work surface for plotting. Preferably, this distance also equals the extent of work surface in the X-coordinate direction so that the portion 20 covers the entire work surface in this direction.

After the drive motor 54 disengages, the controller provides a command signal to the drive motor 58 which rotates the feed roller 30 in the direction indicated by arrow B to advance the paper web across the work surface in the X-coordinate direction a distance which equals the length of paper supplied from the roll 26. Thus, the feed mechanism operates to advance a fresh portion 20 of the web onto the work surface for plotting.

Once the feed roller advances the web the required distance, the controller provides command signals to the pen head 46 and the carriage 48 to cause a graphic to be printed onto the portion 20 of the web advanced by the feed mechanism. After the plotting of this portion of the web is complete, the control procedure is repeated to advance a fresh portion of the web to the work surface. The procedure is continuously repeated until plotting of the entire mark or other desired drawing is complete.

While preferred embodiments have been shown and described, various modifications and substitutions may be made without departing from the spirit and scope of the invention. Accordingly, it is to be understood that the present invention has been described by way of example and not by limitation.

I claim:

1. A segmented dancer bar for use in a sheet material feed mechanism, said dancer bar comprising a plurality of segments flexibly linked together, each of said segments having a male end and an opposite female end, each of said ends defining a socket, each male end further including a pin pressed into the corresponding socket, said pin being insertable into the socket defined by the female end of another of the plurality of segment to flexibly link the segments together to prevent bowing, such that the bar provides a uniform downward pressure along its entire length.

2. The dancer bar of claim 1 wherein the bar has a length substantially equal to the width of the sheet material and applies substantially equal pressure along the entire width of the sheet material.

3. The dancer bar of claim 1 wherein the segments comprising the bar are generally cylindrical in shape.

4. The dancer bar of claim 1 wherein the plurality of segments are selectively combined so that the length of the dancer bar substantially equals the width of the sheet material.

5. The dancer bar of claim 4 wherein at least two of the segments are of differing length.

6. A feed mechanism for use with an apparatus for performing a work operation on sheet material comprising:

means for supporting a supply roll of the sheet material;

a feed roller for receiving sheet material from the supply roll and advancing the sheet material across a work surface of the apparatus;

said supply roll and feed roller arranged relative to one another to define a loop of sheet material extending therebetween; and a dancer bar received within the bight of the sheet material loop to pull said sheet material downwardly with constant tension, said dancer bar including a plurality of segments flexibly linked together, each of said segments having a male end and an opposite female end, each of said ends defining a socket, each male end further including a pin pressed into the corresponding socket, said pin being insertable into the socket defined by the female end of another of the plurality of segment to flexibly link the segments together to prevent bowing, such that the bar provides a uniform downward pressure along its entire length.

7. The feed mechanism of claim 6, wherein the plurality of segments are selectively combined so that the length of the dancer bar substantially equals the width of the sheet material and the dancer bar applies substantially equal pressure along the entire width of the sheet material.

8. The feed mechanism of claim 6 further comprising:

means for causing the supply roll to unwind and supply sheet material to form the loop; and means for sensing the vertical height of the dancer bar received within the bight of the loop when a predetermined length of sheet material has been supplied; and means for causing the supply roll to discontinue unwinding and supplying sheet material in communication with the means for sensing after the given length of sheet material has been advanced.

9. The feed mechanism of claim 6 further comprising:

means for causing the supply roll to unwind and supply sheet material and discontinue unwinding in response to the vertical height of the dancer bar received within the bight of the loop of sheet material.

10. The feed mechanism of claim 6 further comprising a take-up roll for receiving sheet material advanced across the work surface of the apparatus by the feed roller.

11. The feed mechanism of claim 10 wherein the take-up roll is drivingly connected to the feed roller.

12. An apparatus for performing a work operation on sheet material, said device comprising:

a work surface for supporting the sheet material during the work operation, said work surface having an input end and a take-off end;

a tool supported above the work surface for movement relative thereto in response to command signals from a controller;

means for supporting a supply roll of the sheet material at the input end of the work surface;

a feed roller for receiving sheet material from the supply roll and advancing the sheet material across the work surface of the device;

said supply roll and feed roller arranged relative to one another to define a loop of sheet material extending therebetween; and a dancer bar received within the bight of the sheet material loop to pull said sheet material downwardly and apply tension thereto, said dancer bar including a plurality of segments flexibly linked together, each of said segments having a male end and an opposite female end, each of said ends defining a socket, each male end further including a pin pressed into the corresponding socket, said pin being insertable into the socket defined by the female end of another of the plurality of segment to flexibly link the segments together to prevent bowing, such that the bar provides a uniform downward pressure along its entire length.

13. The device of claim 12, wherein the plurality of segments are selectively combined so that the length of the dancer bar substantially equals the width of the sheet material and the dancer bar applies substantially equal pressure along the entire width of the sheet material.

14. The device of claim 13 further comprising:

means for causing the supply roll to unwind and supply sheet material to form the loop; and means for sensing the vertical height of the dancer bar received within the bight of the loop when a predetermined length of sheet material has been supplied; and means for causing the supply roll to discontinue unwinding and supplying sheet material in communication with the means for sensing after the given length of sheet material has been advanced.

15. The device of claim 13 further comprising:

means for causing the supply roll to unwind and supply sheet material and discontinue unwinding in response to the vertical height of the dancer bar received within the bight of the loop of sheet material.

16. The device of claim 12, wherein the feed roller is positioned at the take-off end of the work surface and the bight of the loop of sheet material is located between the supply roll and the input end of the work surface.

17. The device of claim 16 further comprising a take-up roll drivingly connected to the feed roller for receiving sheet material advanced across the work surface by the feed roller.

18. The device of claim 12 further comprising means cooperating with the feed roller to define a nip therebetween for gripping the sheet material.

19. The device of claim 18 wherein the means cooperating with the feed roller comprises at least one gripping member moveable between a gripping position wherein the member engages the feed roller to define the nip and a non-gripping position wherein the gripping member does not engage the feed roller.

20. The device of claim 19 comprising a plurality of gripping members spaced along the length of the feed roller.

21. The device of claim 20 further comprising means for adjusting the spacing of the gripping members along the length of the feed roller.

* * * * *